United States Patent [19]

Messerschmitt

[11] 4,373,441

[45] Feb. 15, 1983

[54] HEATABLE SIEVE FOR SCREEN PRINTING

[76] Inventor: Elmar Messerschmitt, Paul-Hösch-Str. 13, 8000 München 60, Fed. Rep. of Germany

[21] Appl. No.: 227,072

[22] PCT Filed: Apr. 23, 1980

[86] PCT No.: PCT/EP80/00023

§ 371 Date: Dec. 23, 1980

§ 102(e) Date: Dec. 12, 1980

[87] PCT Pub. No.: WO80/02257

PCT Pub. Date: Oct. 30, 1980

[51] Int. Cl.[3] ..... B05C 17/06; B05C 17/08

[52] U.S. Cl. ..... 101/127.1; 101/128.4

[58] Field of Search ..... 101/127–129, 101/112

[56] References Cited

U.S. PATENT DOCUMENTS

| | | | |
|---|---|---|---|
| 3,167,004 | 1/1965 | Miller | 101/127.1 |
| 3,800,697 | 4/1974 | Sullivan | 101/127.1 |
| 4,028,230 | 6/1977 | Rosenblum | 101/127.1 X |

FOREIGN PATENT DOCUMENTS

| | | | |
|---|---|---|---|
| 634954 | 1/1962 | Canada | 101/127.1 |

*Primary Examiner*—A. J. Heinz

*Attorney, Agent, or Firm*—Herman L. Gordon

[57] ABSTRACT

A screen printing frame assembly for use with thermoplastic inks. The frame has opposite frame rail portions with thermoplastic resin material thereon. A stainless steel printing screen has low-resistance opposite end portions overlying and thermoplastically secured on said resin material, the remainder of the screen between the low-resistance portions being of higher resistivity and being spaced from the resin material. Respective electrical connection terminals are mounted on the low-resistance portions for connecting a source of current to the screen. The screen portion between the low-resistance portions is thus heated to a working temperature when energized by the electrical current source, while the low-resistance portions remain relatively cool and do not melt the thermoplastic resin material on which they are secured.

7 Claims, 26 Drawing Figures

FIG. 8
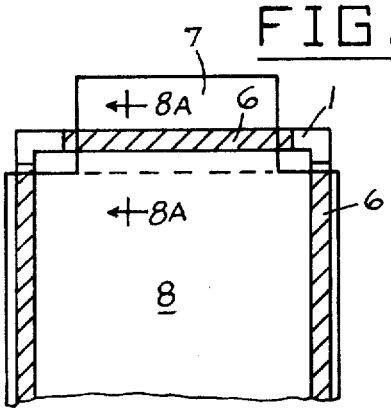
FIG. 8B
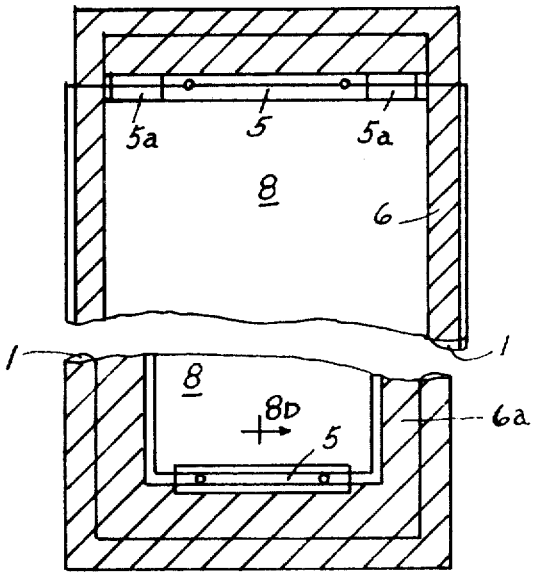
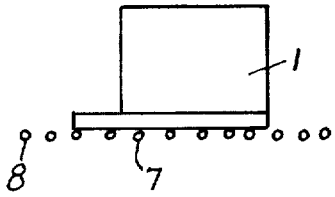
FIG. 8A
FIG. 8C
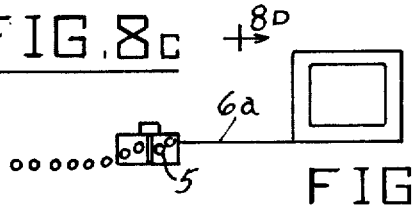
FIG. 8D
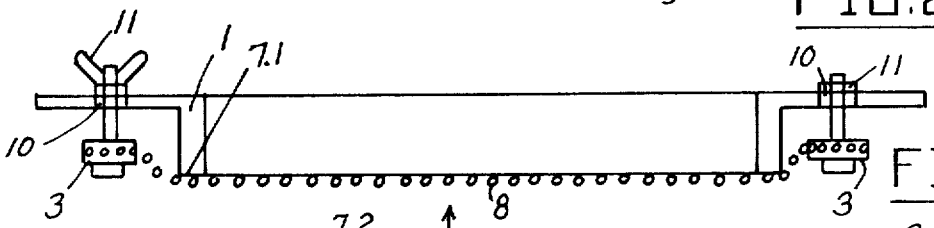
FIG. 9
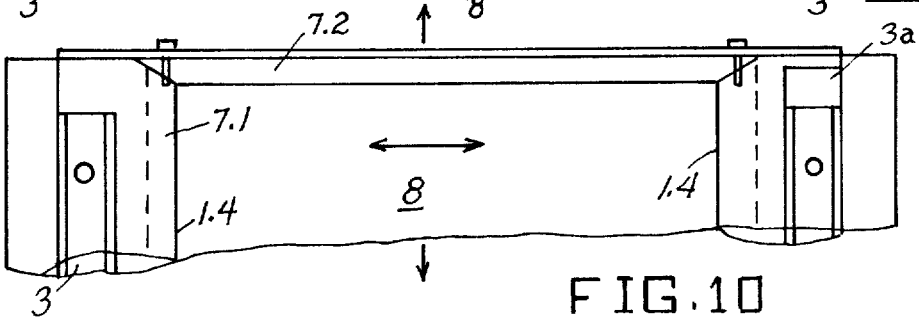
FIG. 10
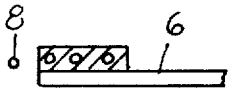
FIG. 10A
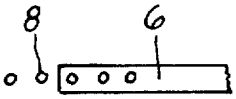
FIG. 10B
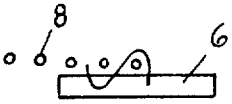
FIG. 10C

HEATABLE SIEVE FOR SCREEN PRINTING

FIELD OF THE INVENTION

This invention relates to screen printing frames, and more particularly to printing frames for use with thermoplastic ink.

BACKGROUND OF THE INVENTION

Screen printing processes are known in which, for using thermoplastic printing inks, a chrome-nickel steel screen is used which is electrically heated by joining its opposite sides to a current supply. For functioning, such steel screens have to be insulated at the positions where they are supported and fixed in position, this being done by having an insulating material, such as rubber or plastics, between the frame and the screen, this making for a complex screen fixing system designed for pulling the screen tight on the one hand and at the same time stopping any danger of electric shocks. For this reason it is normal for non-conducting lengths of fabric to be stitched on to the two sides of the edges of the steel screen and these strips are then fixed to the frame mechanically with or without a system for pulling the screen tight on later use, while the two other opposite sides of the steel screen or fabric are loosely rested or guided over insulating bridges on the frame and run to points on which they are joined with an electrically insulated system for pulling the screen tight. A screen fixing system, with which the screen may be pulled tight later as desired, is better, because, when the screen is heated, it becomes extended, that is to say less tight. In a simple system the metal screen is directly fixed to a wood frame. However screens have been bedded or seated in thermosetting (that is to say not thermoplastic) synthetic resin screen frames. No suggestion has been made so far for using adhesives without a mechanical join at the same time, because adhesives are generally thermoplastic and the heated screen would, it would seem, then become loose.

SUMMARY OF THE INVENTION

The problem stated above is taken care of in the present invention because the screen fabric is bedded in thermoplastic synthetic resin on one or more sides, for example by ironing it on, injection molding and the like, and for stopping the danger of the screen becoming loose at overhigh temperatures and/or on pulling forces acting on the screen, certain measures are put forward in the invention.

(1) If the resin/wire connection is in the direction of the current, the current input and output connections are made narrower than the space between the connections, (2) if the resin/wire connection is normal to the direction of the current, the steel screen is decreased in resistance from the current terminal as far as the said connection, for example by copper-plating, so that it is not heated or is only hardly heated at these points.

(3) The two ends of the current path are within the thermoplastic screen fixing system on the frame and the current does not go across the fixing system.

Using these measures screen printing frames are put forward by the invention which have a thermoplastic, insulating casing or inlay, for example made of polyethylene, and in which (for making the said wire/resin connection) the screen fabric is bedded, for example by using heat and pressure.

The casing may be produced by a shrinking process, spraying on or fluidized bed sintering. The inlay may have the form of a plastics section which may be then designed so as to be undone from the frame, even when the screen is fixedly joined up with it. This part of the invention is more specially useful for frames which have a system for pulling tight the screen for purposes of adjustment. For heatable screens of great size it is furthermore possible to make use of a thermoplastic electric frame or edging as in the German Pat. No. 1,671,636 on making use of the measures noted.

An account will now be given of the invention in more detail using working examples.

BRIEF DESCRIPTION OF THE DRAWINGS

FIG. 8 is a fragmentary horizontal sectional view of a further modification of a frame and screen assembly according to this invention.

FIG. 8A is an enlarged cross-sectional view taken on line 8A—8A of FIG. 8.

FIGS. 8B and 8C show modifications of FIG. 8.

FIG. 8D is an enlarged cross-sectional view taken on line 8D—8D of FIG. 8C.

FIG. 9 is a vertical cross-sectional view of a further modification of a frame and screen assembly according to this invention.

FIG. 10 is a fragmentary plan view of the assembly of FIG. 9.

FIGS. 10A, 10B and 10C are enlarged cross-sectional views showing different types of connections between the insulating material which can be used in the assembly of FIGS. 9 and 10.

DETAILED DESCRIPTION OF PREFERRED EMBODIMENTS

Figure 1:
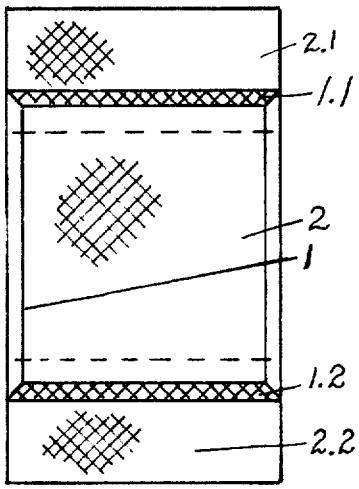
FIG. 1 is a horizontal sectional view of a frame and screen assembly according to the present invention.

FIG. 1 is a view of the frame (1), which at two opposite sides 1.1 and 1.2 has a synthetic resin coating. The screen or screen fabric (2) is fixed to the same and copper-plated at the end faces 2.1 and 2.2.

Figure 2:
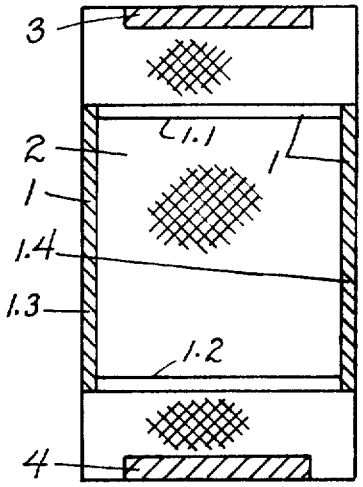
FIGS. 2 to 6 are horizontal sectional views of modifications of frame and screen assemblies according to the present invention.

FIG. 2 is a view of of a modification including the frame (1) which at sides 1.3 and 1.4 has synthetic resin rails. At its ends screen fabric (2) has beams (3 and 4) having a low electrical resistance and which are shorter than the frame sides 1.1 and 1.2, that is to say the straight connecting lines between the ends of the beams come short of the synthetic resin rails.

Figure 3:
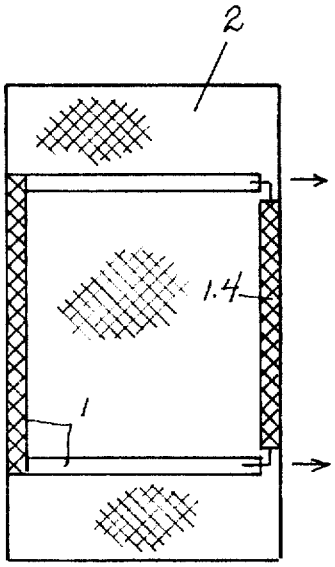

In the modification of FIG. 3 the synthetic resin is so placed in relation to frame (1) on side 1.4 that the synthetic resin may undergo adjustment in an outward direction.

Figure 4:
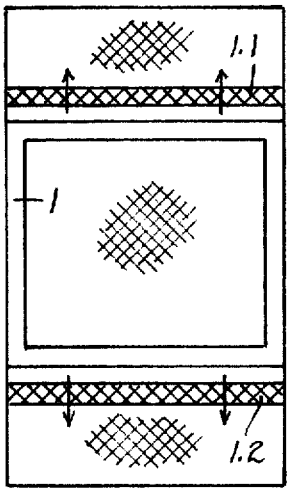

In the modification of FIG. 4 on frame (1) sides 1.1 and 1.2 have a moving system, on which the synthetic resin is placed.

Figure 5:
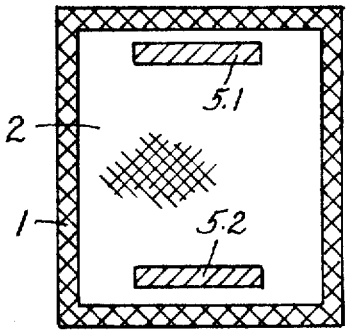

FIG. 5 is a view of a further modification of frame (1) with a heatable screen (2) through which the current goes by way of a current input and a current output, for example in the form of low resistance beams 5.1, 5.2, these beams being placed within the screen so that the current is kept clear of the thermoplastic resin/wire connection (1.1 to 1.4). The current connection is soldered or tightly fixed on the screen.

Figure 1A:
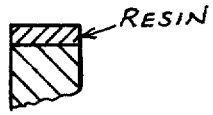
FIGS. 1A, 1B and 1C are enlarged cross-sectional views of different frames provided with synthetic resin sections.
Figure 1B:
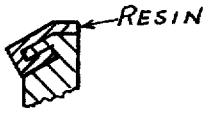
Figure 1C:
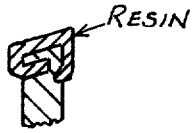

Screen printing frames of any design may be used, special-purpose frames being seen in FIGS. 1A, 1B and 1C with synthetic resin sections which may be fixed in position for the time being or permanently.

Figure 6:
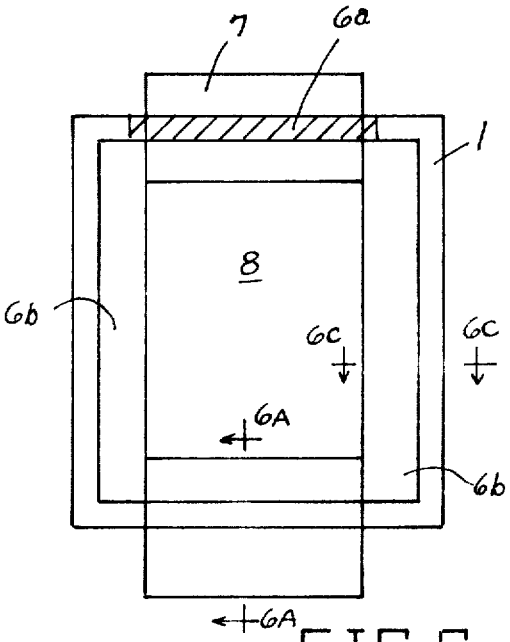
Figure 7:
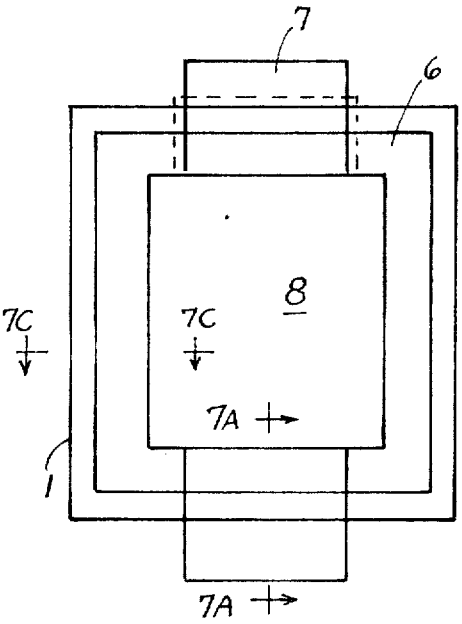
FIG. 7 is a plan view of a modification of FIG. 6.
Figure 6A:
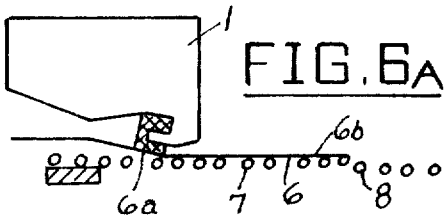
FIG. 6A is an enlarged cross-sectionsl view taken on line 6A—6A of FIG. 6.
Figure 7A:
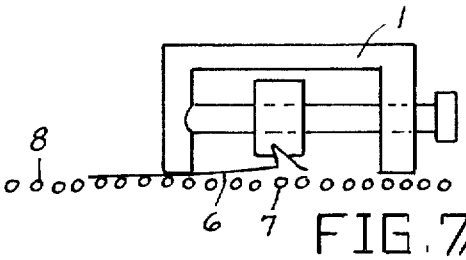
FIG. 7A is an enlarged cross-sectional view taken on line 7A—7A of FIG. 7.
Figure 6B:
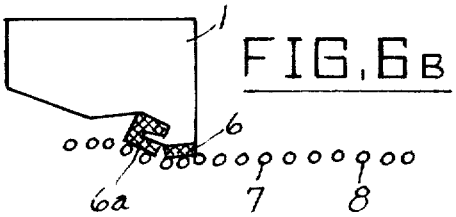
FIG. 6B shows a modification of FIG. 6A.
Figure 7B:
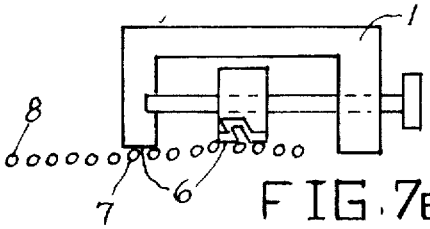
FIG. 7B shows a modification of FIG. 7A.
Figure 6C:
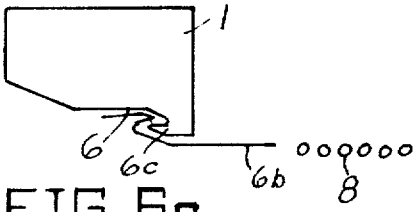
FIG. 6C is an enlarged cross-sectional view taken on line 6C—6C of FIG. 6.
Figure 7C:
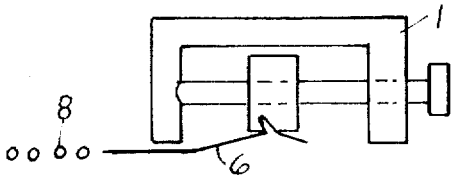
FIG. 7C is an enlarged cross-sectional view taken on line 7C—7C of FIG. 7.

FIGS. 6, 7 and 8 are views of a selection of three known frame systems for making clear teachings of the invention which are able to be used for all other frame systems if desired.

In these figures:

1 is the frame, 6 is insulating (non-conducting) fabric or foil or coating (layer, adhesive, etc.)

7 is low-resistance conducting screen fabric or foil or connection material, and 8 is high resistance conducting screen fabric.

FIGS. 6 and 7 are views of two widely used self-tensioning frames. The elastic screen support edging 6*b* (non-insulating fabric or foil) is joined by way of a synthetic resin section 6*a* or kept in position by a gripper 6*c*. It is joined with the screen 7 and 8. The parts at the face of the screen which are not to be heated (7) are conducting and have a low resistance, this being made possible by, for example, electroplating.

FIG. 8 is a view of a stiff frame, for example of metal section (more specially welded or plugged together at its corners).

In FIG. 8A the frame (1) is joined up with the screen fabric (7 and 8) by way of an insulating, separating cover, which is more specially thermoplastic (6), this being done by adhesion, sintering or bedding of the screen in position. In this case the direction of the screen part (7) stretching in the direction of the current is made with a low resistance. In FIG. 8B the frame (1) is joined with the heated screen fabric (8) partly as in FIG. 8A and partly by way of a fabric and/or foil (6*a*), which have an insulating effect. The current supply is by way of low-resistance terminals (5) which at the same time have the function of a connection and for this reason may be partly insulated (part piece 5*a*). In FIG. 8C the heated fabric is edged, for supporting it, with insulating fabric or foil (6*a*), more specially of a thermoplastic sort, on all sides.

In FIG. 9 a design for smaller sizes of screen will be seen. The frame 1 has more specially thermoplastic insulation (7.1) (foil, section, coating or adhesive) which is fixed in position or may be designed so that it may be pulled off, and on which the heated screen 8 is fixed (7.2) or is rested slopingly (7.1). Such heated screen fabric or screen is pulled tight by the insulatedly (10) supported terminal (3) in the arrowed direction. The two frame sides (1.4) or only one of them may be put in position in the direction marked by the double arrow for pulling the fabric tight, more specially by motion in the arrowed direction or by rails or arrows (11) for pulling it tight. The current output terminal rails (3) are however of such a design and so insulated (3*a*) that they only give up their current in a straight connection within the frame, to the heated fabric or screen, that is to say the ends are shorter than the inside size of the frame, and inasfar as they go further than it they are insulated (3*a*). This design may furthermore be used for so called "conical" screens.

FIGS. 10A, 10B and 10C are views of connections between the heated screen (8) and the insulation (6).

FIG. 10A shows adhesive.

FIG. 10B shows seats or a bed.

FIG. 10C shows stitching (may be used together with FIGS. 10A and 10B)

The gripping effect will be at terminal 5 in FIGS. 8A and 8C, the terminal being used for the flow of current at the same time.

I claim:

1. A screen printing assembly for use with thermoplastic inks comprising a supporting frame having opposite frame rail portions, thermoplastic synthetic resin material on said frame rail portions, a printing screen of electrically conducting material which can be heated by transmitting electrical current therethrough, said screen having relatively low-resistance opposite portions of increased conducting cross-sectional area overlying, in contact with, and thermoplastically secured on said synthetic resin material, the remainder of the screen between said low-resistance portions being of higher resistivity and being spaced from said resin material, and respective terminal means on said low-resistance portions for connecting a source of electrical current to said screen to heat the screen, whereby to cause the screen portion between the low-resistance portions to be heated to a working temperature responsive to the connection of a source of current to said terminal means, while said low-resistance portions thermoplastically secured on said synthetic resin material are heated to a lower temperature and are relatively cool so as to prevent melting of the resin material, and wherein said low-resistance portions comprise metallic plating on the screen.

2. The screen printing assembly of claim 1, and wherein said electrical terminal means comprises respective metallic bars conductively bonded on said screen parallel to said frame rail portions.

3. The screen printing assembly of claim 1, and wherein said electrical terminal means comprises respective metallic bars conductively secured on said screen parallel to said frame rail portions, the ends of the bars being spaced inwardly from the side marginal edges of the screen.

4. The screen printing assembly of claim 1, and wherein said electrical terminal means comprises respective metallic bars conductively secured on the screen parallel to and spaced outwardly from said frame rail portions.

5. The screen printing assembly of claim 1, and wherein said thermoplastic resin material comprises layers of thermoplastic resin between the screen and the frame.

6. The screen printing assembly of claim 5, and wherein said resin layers are in the form of foil adhesively bonded to the frame.

7. The screen printing assembly of claim 1, and wherein said electrical terminal means comprises respective conductive terminal bars conductively secured to the opposite marginal portions of the screen parallel to said frame rail portions, and adjustable clamping terminal bolt means connecting said conductive bars to the frame rail portions and having means to develop adjustable tension on the screen.

* * * * *